United States Patent [19]

Keller et al.

[11] 4,078,870

[45] Mar. 14, 1978

[54] TANGENTIAL BLOWER

[75] Inventors: Bruno Keller; Wolfgang Engelhardt, both of Landshut, Germany

[73] Assignee: International Standard Electric Corporation, New York, N.Y.

[21] Appl. No.: 696,785

[22] Filed: Jun. 16, 1976

[51] Int. Cl.[2] ..... F04D 17/08; F04D 29/40

[52] U.S. Cl. ..... 415/54; 415/119; 415/209; 415/219 C

[58] Field of Search ..... 415/54, 119, 209, 219 C

[56] References Cited

U.S. PATENT DOCUMENTS

| | | | |
|---|---|---|---|
| 2,991,927 | 7/1961 | Quick | 415/209 |
| 3,034,702 | 5/1962 | Larsson et al. | 415/209 |
| 3,477,635 | 11/1969 | Glucksman et al. | 415/209 |
| 3,522,994 | 8/1970 | Zenkner | 417/371 |
| 3,695,775 | 10/1972 | Zenkner | 415/119 |

FOREIGN PATENT DOCUMENTS

| | | | |
|---|---|---|---|
| 683,614 | 4/1964 | Canada | 415/54 |
| 717,377 | 9/1965 | Canada | 415/54 |
| 803,865 | 4/1951 | Germany | 415/209 |
| 2,414,610 | 10/1975 | Germany | 415/54 |

*Primary Examiner*—C. J. Husar
*Attorney, Agent, or Firm*—A. Donald Stolzy

[57] ABSTRACT

A tangential blower stands out for its low noise level as a result of a specially constructed baffle plate inlet edge, vortex former and pressure connection. It is also possible to vary air-inlet and air-outlet cross sections and thus influence the blower characteristic.

10 Claims, 16 Drawing Figures

TANGENTIAL BLOWER

BACKGROUND OF THE INVENTION

The present invention relates to a blower, and more particularly to a tangential blower including a rotor, a spiral-shaped baffle plate which passes from the spiral shape into a plane portion in the region of the high-pressure side and, after its closest approach to the rotor at the high-pressure side, extends away from the rotor at the low-pressure side in a sharp bend. The blower also includes end plates and a vortex-forming system which separates the low-pressure side from the high-pressure side. The system includes two or more guidewalls whose edges extend transversely to the direction of flow, are straight over their entire lengths and are parallel to the blade edges of of the rotor. The guidewalls form passages that converge toward the rotor and are open at both ends.

Tangential blowers are known, e.g. from Belgian Pat. No. 599,024, whose rotors have a twisted, helical, swept-back or axially staggered blading to reduce the noise of the blades. They are very expensive to manufacture.

German Printed Application No. 1,277,505 describes tangential blowers wherein the distance between the rotor and the baffle plate inlet edge and/or the inside edge of the vortex former is enlarged to reduce the blower noise. This causes considerable pressure losses.

Various other prior art blower designs with or without the use of recirculation are known from, e.g., German Printed Applications Nos. 1,428,071, 1,503,668 and 1,503,673, German Published Applications Nos. 1,951,115, 2,030,837 and 2,048,541 and from German Petty Patent No. 1,980,832. Unless provided with expensive control elements, each of those blowers can only be operated either with or without the use of recirculation and, therefore, has only one throttling characteristic $\psi = f(\phi)$ which corresponds to its construction. In this equation, $\psi$ is the pressure figure, and $\phi$ the delivery figure.

Each of the above-mentioned blowers can have its low- or high-pressure side connected to only one cross section without loss of efficiency unless expensive connections are used. None of these blowers suppresses bothersome blade noise over a sufficiently wide throttling range. The field of application thereof thus remains limited.

SUMMARY OF THE INVENTION

A low noise level requires that the blade noise with the blade frequency $n \cdot Z/60$ ($n$ = speed of the blower, Z = number of blades) be suppressed as far as possible because the blades generate noise peaks lying primarily in the range of the highest sensitivity of the human ear.

A second requirement is that different cross sections must be provided for the low- and high-pressure sides. These permit the tangential blower to be connected to existing tube cross sections without blower modification. It also must be possible to install the blower in different kinds of equipment, some types of which require a large air volume, i.e. a high delivery figure $\phi$, while others need a high pressure, i.e. a high pressure figure $\psi$. A blower of conventional design using no recirculation is suited best for a high delivery figure, while a high pressure figure is best achieved with a blower using recirculation where part of the energy-rich air is taken from the high-pressure side and fed back into the rotor.

The requirement for high $\phi$- and $\psi$-values results, on the one hand, from the use of asynchronous motors which is common in the construction of small blowers. These motors drive the rotor directly and have only a limited speed range. On the other hand, said requirement results from a need or desire for a low noise level.

The invention is characterized in that a baffle plate is provided that has, in the region of the pressure connection, an air-deflecting edge in the form of a step, breakaway edge or wave which extends parallel to the rotational axis of the rotor along the entire length of the tangential blower or of parts thereof. The baffle-plate inlet edge is maintained parallel to the blade edges of the rotor and has steplike offsets between end plates. Air outlet slots at the guidewalls are so divided in the direction of the said rotor axis so as to be staggered in relation to one another in a steplike arrangement by 0.3 to 0.7 times the blade pitch $t$.

To improve adaptability to different tube cross-sections, a preferred embodiment of the invention is characterized in that the lowermost guidewall of the vortex former and the plane portion of the baffle plate form the pressure connection. The pressure connection has a cross-section which is constant or expands in the direction of flow. The low-pressure side of the tangential blower can be connected to inlet ducts of different cross-sections with the aid of those edges of the guidewalls which do not face the rotor as well as with the rotor end plates and the baffle-plate inlet edge and/or at the high-pressure side, the pressure connection of the tangential blower can be connected to outlet ducts of different cross-sections with the aid of those edges of the guidewalls which do not face the rotor. The pressure connection can also be so connected with the aid of the blower end plates and the air outlet edge at the baffle plate. The edges of the guidewalls of the vortex-forming system which do not face the rotor are maintained straight and parallel to the end edge of the baffle-plate inlet edge, and said edges, viewed in the order from bottom to top, are displaced with respect to one another in the direction of the rotor, each by at least the smallest distance between two guide walls of the vortex-forming system.

The above-described and other advantages of the present invention will be better understood from the following detailed description when considered in connection with the accompanying drawings.

BRIEF DESCRIPTION OF THE DRAWINGS

In the drawings which are to be regarded as merely illustrative.

DESCRIPTION OF THE PREFERRED EMBODIMENTS

Figure 1:
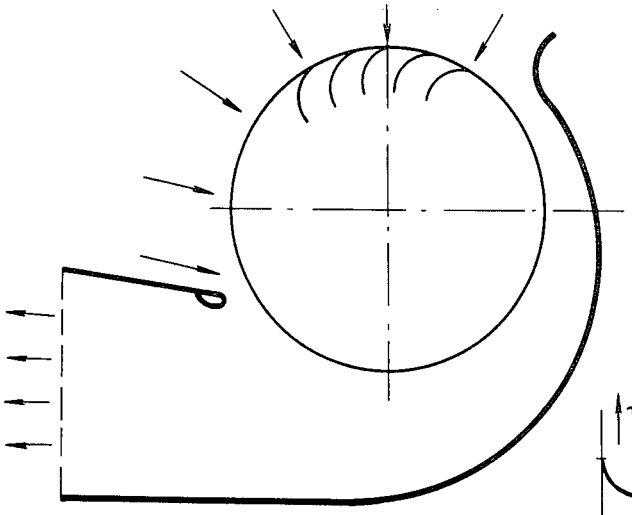
Fig.1 PRIOR ART
FIG. 1 is a diagrammatic view of a prior art type tangential blower without the use of recirculation.
Figure 2:
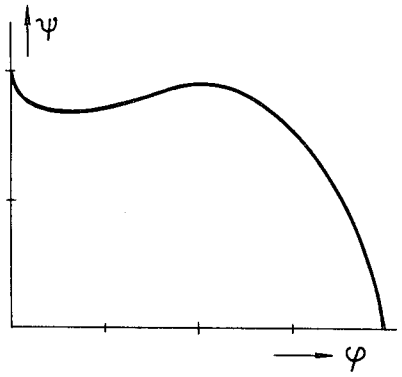
Fig.2 PRIOR ART
FIG. 2 is a throttling function graph $\psi = f(\phi)$ of the tangential blower of FIG. 1.

FIG. 1 shows a prior art type tangential blower without recirculation. Its throttling curve, shown in FIG. 2, has a relatively small maximum pressure figure $\psi_{max}$, but a relatively large maximum delivery figure $\phi_{max}$.

Figure 3:
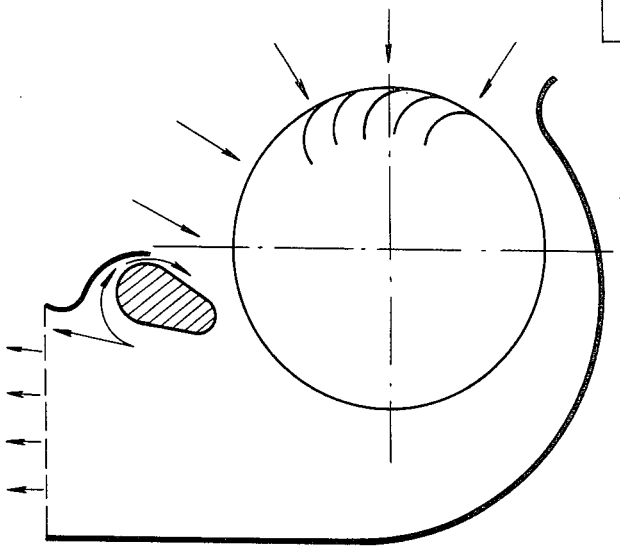
PRIOR ART Fig.3
FIG. 3 is a diagrammatic view of a prior art type tangential blower using recirculation.
Figure 4:
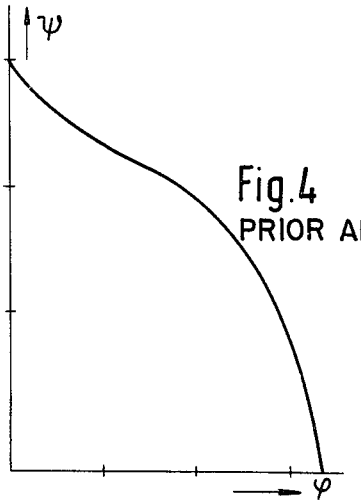
Fig.4 PRIOR ART
FIG. 4 is a throttling function graph $\psi = f(\phi)$ of the tangential blower of FIG. 3.

A prior art type tangential blower using recirculation is shown in FIG. 3. Its throttling curve, shown in FIG. 4, shows a high maximum pressure figure and, because of the loss of recirculating air, a maximum delivery figure slightly lower than that of the same tangential blower without recirculation. In all prior art type tangential blowers, the energy-rich air supplied to the rotor is taken directly from the pressure connection.

Figure 5:
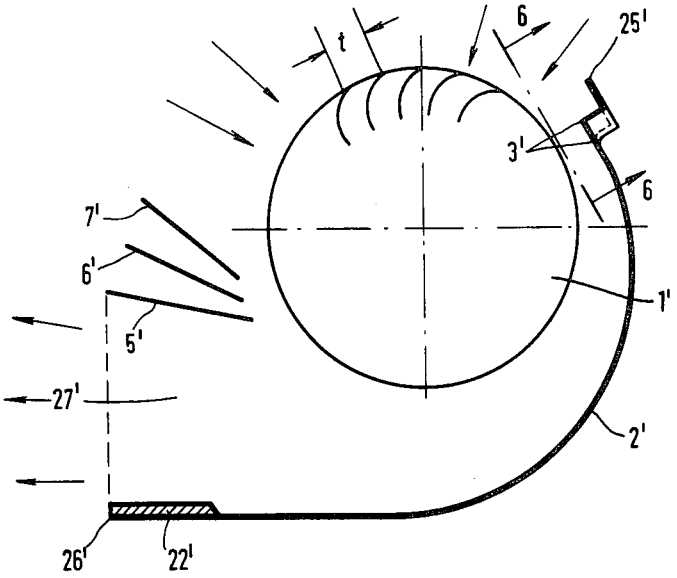
FIG. 5 is a diagrammatic view of a tangential blower constructed in accordance with the present invention.
Figure 6:
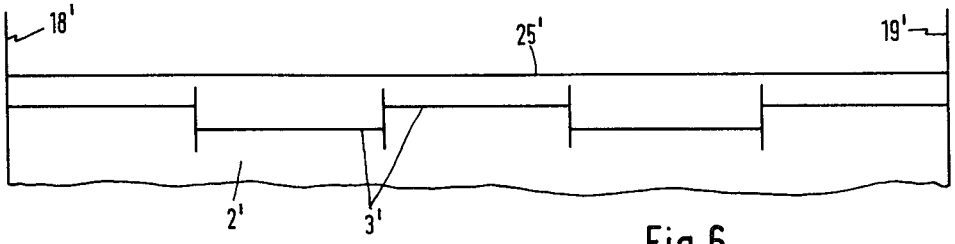
FIG. 6 is a radial view of the blower taken on the line 6—6 shown in FIG. 5.

An embodiment of a tangential blower constructed in accordance with the present invention is shown in FIGS. 5 and 6. The blower consists of a rotor 1' (see 1'''in FIG. 8), a baffle plate 2' with the baffle-plate inlet edge 3', a pressure connection 27', and a vortex-forming system with the guidewalls 5', 6' and 7'. Located in the region of the pressure connection 27' at the baffle plate 2' and at a distance of 0 to 0.5 times the diameter of the rotor 1' from the air-outlet edge 26' is a deflecting edge in the form of a step 22', a break-away edge 23'''' (FIG. 9) or a wave 24''' (FIG. 8) which deflects the air current toward the vortex former and thus stabilizes the air current in case of changeover to the recirculation mode, simultaneously influencing the noise characteristics in a favorable manner. The deflecting edge extends parallel to the rotation axis of the rotor 1' over the full length of the tangential blower or over parts thereof; its maximum height corresponds to 0.08 times the diameter of the rotor 1'.

Herein, 10, 20, 30, 50, 60, 70, 220, 250 and 260 may be similar to 1', 2', 3', 5', 6', 7', 22', 25' and 26', respectively, and to the following respective sets:

| | | |
|---|---|---|
| Set 1: | 11, 21 | ... |
| Set 2: | 12, 22 | ... |
| Set 3: | 13, 23 | ... |
| Set 4: | 14, 24 | ... |
| Set 5: | 1'', 2'' | ... |
| Set 6: | 1''', 2''' | ... |
| Set 7: | 1'''', 2'''' | ... |
| Set 8: | 1''''', 2''''' | ... |

and to all numbers less than 1000 with none, one or more up to and including five primes.

Figure 8:
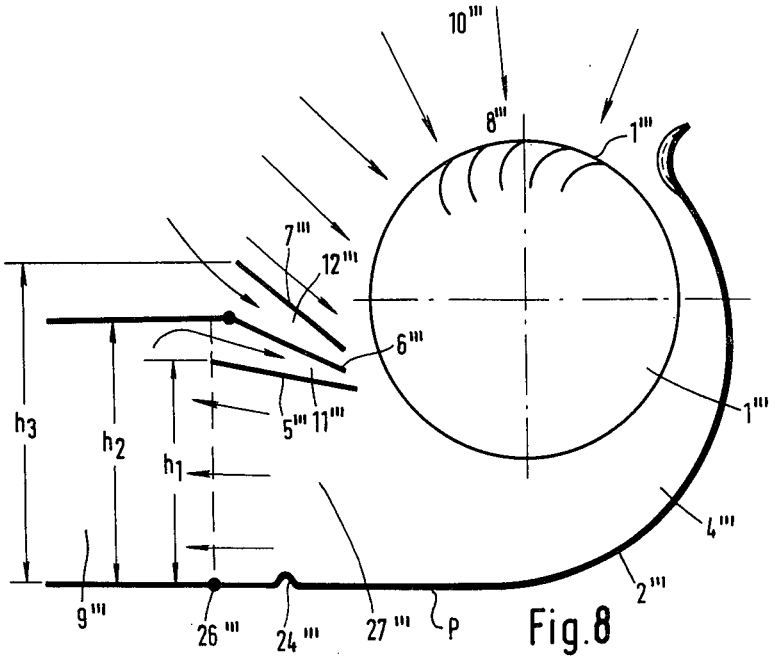
FIGS. 8 and 9 are diagrammatic views of third and fourth embodiments of the present invention, respectively.

Note will be taken that baffle 2''', for example in FIG. 8, is spiral-shaped and is mounted around rotor 1'''. Baffle 2''' extends in its spiral shape into a planar portion P. The outlet or high pressure region is located between portion P and rotor 1'''. Connection 27''' is the high pressure connection thereto. Baffle 2''', after its closest approach to rotor 1''' near the top of baffle 2''' in FIG. 8 where the inlet or low pressure side 8''' is located, extends downwardly in FIG. 8 from low pressure side 8''' away from rotor 1''' in a curve.

Figure 7:
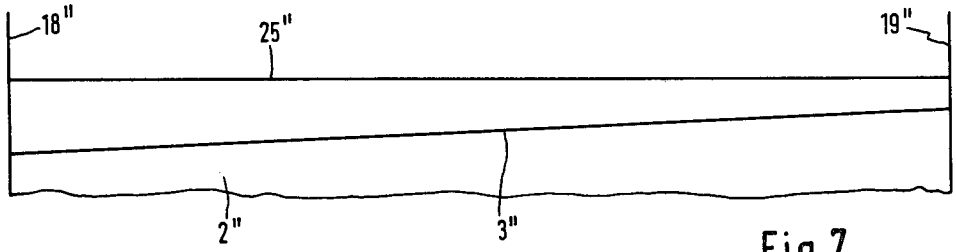
FIG. 7 is a view similar to FIG. 6 of an alternative embodiment of the present invention.

FIGS. 6 and 7 show embodiments of air inlet edges 3' and 3'' at baffle plates 2' and 2''. Regarding the blade frequency, this air inlet edge has not been utilized so far since this has not appeared promising because of the reversal of the direction of flow in the adjacent blade region. In the passages between the blades there are considerable pressure variations which excite noise with the blade frequency.

If the baffle-plate inlet edges 3' and 3'' are inclined continuously or offset in steplike manner by a 0.3 to 1.5 blade pitch $t$ between the end plates 18', 18'' and 19', 19'' of the blower, part of the frequency peaks are reduced as a blade of the blower always moves only past portions of one of the casing edges. For reasons of installation, end edges 25' and 25'' are straight and parallel to the rotation axis of the rotor 1'.

Figure 9:
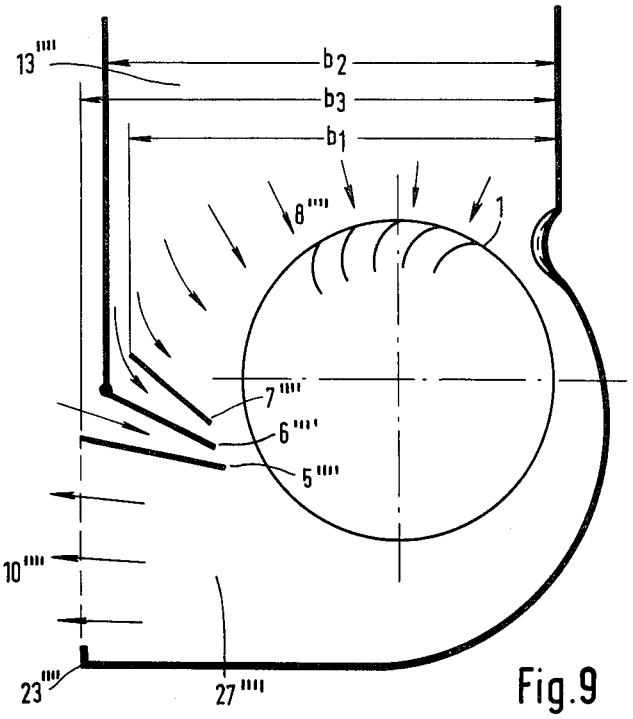

Two other embodiments are shown in FIGS. 8 and 9. After its closest approach to the rotor 1''' at the high-pressure side 4''', at the low-pressure sides 8''' and 8'''' baffle plate 2''' extends away from the rotor in the form of an S-deflection, with the narrowest cross section between baffle plate 2''' and rotor 1''' continuously inclined in relation to the latter's rotation axis by about one blade pitch $t$ along the entire length. The vortex-forming system is composed of guidewalls 5''', 5'''', 6''', 6'''', 7''' and 7'''' and separates the pressure connections 27''' and 27'''' from the low-pressure side. The guidewalls 5''' and 5'''' and the plane portion of the baffle plate 2'41 form the pressure connection, widening in the direction of outflow in the manner of a diffuser, for example. The guidewalls permit different connecting cross sections with the heights $h_1$, $h_2$ and $h_3$ at the high-pressure side. They may be plane or arched, bent or elbow-shaped; they may have a constant thickness throughout or be profiled, for example.

Figure 10:
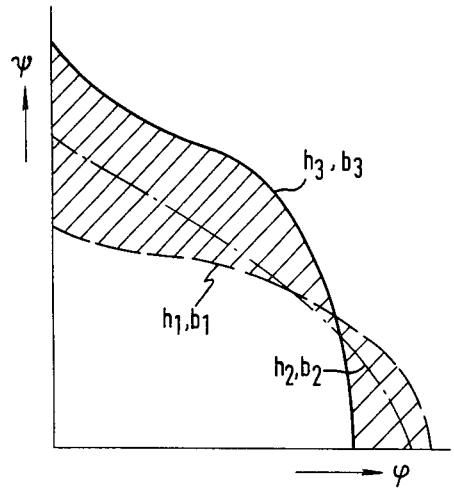
FIG. 10 is a graph of $\psi = f(\phi)$ for the embodiments of FIGS. 8 and 9.

In the drawing, the tangential blower is connected via the cross section determined by the height $h_2$ to an outlet duct 9''' and draws in air from the free atmosphere 10''''. Through the passage 11''' between the guidewalls 5''', 5'''' and 6''', 6'''', recirculation air is fed to the rotor; the passage 12''' between the guidewalls 6''', 6'''' and 7''', 7'''' remains inactive as far as the recirculation is concerned. The guidewalls 7''' and 7'''' perform merely a guiding function for the drawn-in air. If the cross section determined by the height $h_1$ is used to connect the blower to an outlet duct, the blower will operate without any recirculation. If the cross section determined by the height $h_3$ is used, the recirculation can be fully utilized. The throttling curves for these three modes of operation are shown in FIG. 10. It can be seen that the cross sections with $h_1$ and $h_3$ give the maximum delivery and pressure figures, respectively, while the throttling curve for the cross section with the height $h_2$ takes up an intermediate position. In FIG. 9 the tangential blower is connected at the low-pressure side to an inlet duct 13'''' via the cross section determined by the width $b_2$; at the high-pressure side it blows the air out into the free atmosphere 10''''. As a result of the pressure drop between the free atmosphere 10''' (FIG. 8) and the low-pressure side 8''' (FIG. 8), the passage between the guidewalls 5''' and 6''' acts like a recirculation passage; the guidewall 7''' performs merely a guiding function for the drawn-in air. By connecting the low-pressure side 8'''' to that cross section of the inlet duct 13'''' which is determined by the width $b_1$, the blower is operated without any recirculation; by connection to that cross section of the inlet duct 13'''' which is determined by $b_3$, the recirculation can be fully utilized. The end edges of the guidewalls are displaced upwards in relation to one another by the amounts $b_3-b_2$ and $b_2-b_1$, respectively, which must be greater than the smallest distance between the respective guidewalls 5'''' and 6'''', 6'''' and 7'''' to ensure sufficient air supply through the passages.

The throttling curves of FIG. 10 also apply to tangential blowers which are incorporated in a circulation system. Each operating point within the envelopes of the hatched throttling range is adjustable by suitable throttling of the recirculating air from outside, i.e. from the connected equipment, without the need for changes in the blower.

Figure 11:
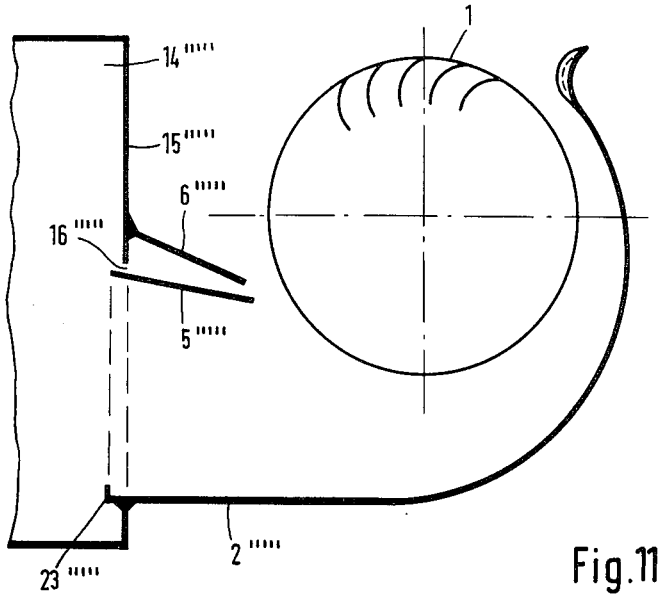
FIGS. 11 and 12 are diagrammatic views of fifth and sixth embodiments of the present invention.

A possibility of regulating the recirculating air from outside by the type of connection to the equipment will now be explained with reference to the embodiment of the invention shown in FIG. 11. The blower has a vortex-forming system consisting of two guidewalls 5''''' and 6''''' and has its high-pressure side connected to a chamber 14'''''. The connecting wall 15''''' of this chamber is designed as a mask which is sealed tightly to the baffle plate 2''''' and the guidewall 6''''' of the blower; at the guidewall 5''''', however, it leaves a slot 16''''' through which the quantity of recirculating air necessary for the respective throttling curve can flow. It is also possible to allow the recirculating air to pass through slots or holes in the portion of the connecting wall 15''''' between the guidewalls 15''''' and 16''''', which are both sealed to the connecting wall in this case.

Figure 12:
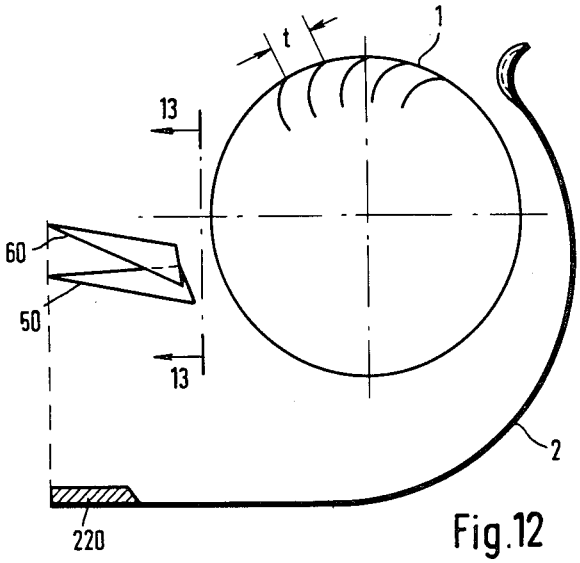
Figure 13:
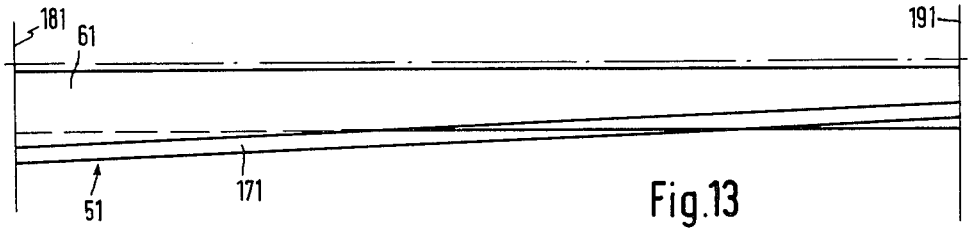
FIGS. 13, 14, 15 and 16 are diagrammatic views of seventh, eighth, ninth and tenth embodiments of the present invention.

A point of the casing which comes close to the rotor and may excite the blade frequency because of the especially high air velocities in this region is the vortex former. By suitably designing the outlets at the side of the rotor as slots with a height of 0.1 to 0.5 times the blade pitch *t* (see FIG. 12), the frequency peaks can be reduced. FIGS. 13 to 16 show embodiments of these slots. FIG. 13 shows an embodiment of the slotlike outlet 171 of the passage between the guidewalls 51 and 61 at the rotor side, which guidewalls are continuously twisted in the axial direction so as to form a slot displaced by about one blade pitch *t* at the two end plates 181 and 191 of the blower and having a constant height.

Figure 14:
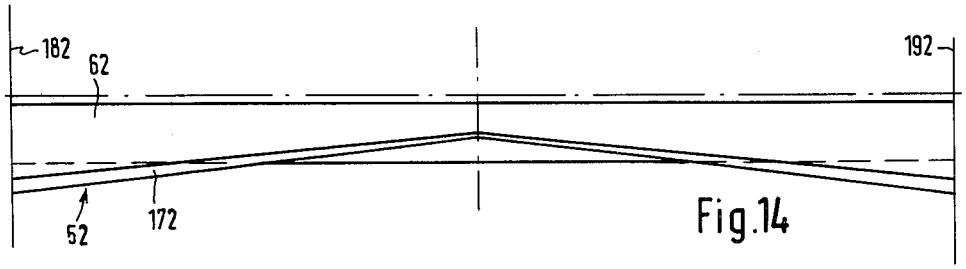

FIG. 14 shows a variant of FIG. 13. The slot is displaced only partially, in this embodiment along one-half the length of the blower; the height of the slot increases from the middle toward the outside. The sweepback of the guidewalls may also be reverse.

Figure 15:
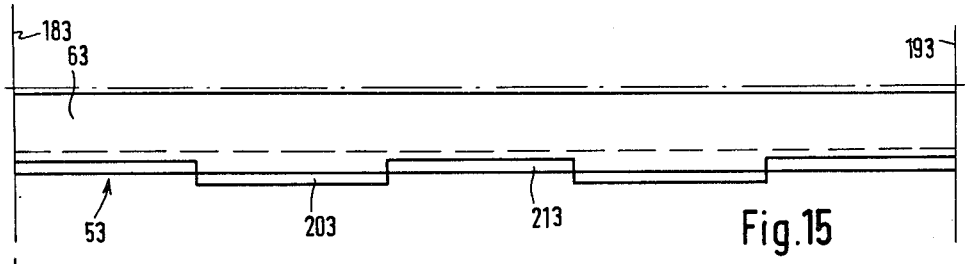

FIG. 15 shows a vortex former in which the air outlet slot is divided in the direction of the blower axis; the resulting slots 204 and 214 are staggered with respect to one another in steplike manner by a 0.3 to 0.6 blade pitch *t*, with the edges of the guidewalls extending parallel to the longitudinal axis of the blower.

Figure 16:
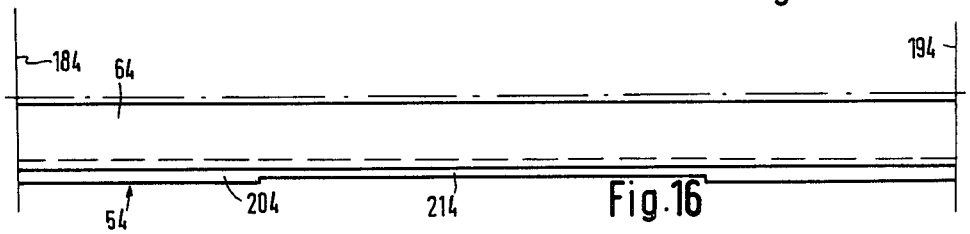

In FIG. 16, the height of the slot in the region of the blower's end plates is 0.5 *t* and thus greater than in the center portion, where it is 0.2 to 0.3 *t*. As a result, in the recirculation mode, more energy is fed to the blower in the region of the end plates than in the center portion, which has a favorable effect on the blower's pressure characteristics.

The embodiments described with reference to FIGS. 12 to 16 can be combined with one another, if desired.

What is claimed is:

1. A tangential blower comprising: a rotor mounted for rotation about an axis and having a plurality of blades with edges extending parallel to said axis; a spiral-shaped baffle plate mounted around said rotor, said spiral-shaped baffle plate extending in its spiral shape into a planar portion that is near a region of a high-pressure side connection, after the closest approach of said spiral-shaped baffle plate to said rotor near a low-pressure side, said spiral-shaped baffle plate extending away from said rotor bending in a spiral toward said planar portion; two end plates of a vortex-forming system which interconnect said low-pressure side and said high-pressure side; at least two guidewalls having edges extending transversely to the direction of flow and extending straight over their entire lengths and being parallel to said blade edges of said rotor, said guidewalls forming passages converging toward said rotor and being open at both ends, said baffle plate having, in a region of said pressure connection, an air-deflecting member which extends parallel to said rotor axis for the distance between said end plates, each baffle-plate inlet edge being parallel to the blade edges of said rotor and having steplike offsets between the said plates; the air outlet slots and a plurality of guidewalls having air outlet slots so divided in the direction of said axis as to be staggered in relation to one another in a steplike arrangement by a 0.3 to 0.7 blade pitch *t*.

2. A tangential blower according to claim 1, wherein the maximum height of said member is equal to about 0.08 times the diameter of said rotor.

3. A tangential blower according to claim 1, wherein said baffle-plate inlet edge has a height equal to a 0.3 to 1.5 blade pitch *t*.

4. A tangential blower according to claim 1, wherein said baffle-plate inlet edge between said end plates is continuously inclined in relation to said axis.

5. A tangential blower according to claim 4, wherein said baffle-plate inlet edge has an inclination between said blower end plates equal to about a 0.3 to 1.5 blade pitch *t*.

6. A tangential blower according to claim 1, wherein said guidewalls have edges of the vortex-forming system which face said rotor are inclined with respect to the blade edges by a given angle along the entire length of the rotor.

7. A tangential blower according to claim 1, wherein said guidewalls have edges which face said rotor and are swept back.

8. A tangential blower according to claim 7, wherein the height of said air outlet slots between those edges of said guidewalls which face said rotor increases from the center toward said end plates.

9. A tangential blower according to claim 1, wherein in the region of said end plates said air outlet slots at said guidewalls are higher than they are in their center portions.

10. A tangential blower according to claim 1, wherein the height of said air outlet slots at said guidewalls amounts to between about a 0.1 to a 0.6 blade pitch *t*.

* * * * *